US005465962A

United States Patent [19]

Hiserman

[11] Patent Number: 5,465,962

[45] Date of Patent: Nov. 14, 1995

[54] BALL ROLLING GAME

[76] Inventor: Franklin R. Hiserman, Rte. 1 Box 417, Waynesboro, Va. 22980

[21] Appl. No.: 136,532

[22] Filed: Oct. 14, 1993

[51] Int. Cl.[6] ..... A63F 7/00

[52] U.S. Cl. ..... 273/118 R; 273/108

[58] Field of Search ..... 273/108, 118 R; 33/756, 770

[56] References Cited

U.S. PATENT DOCUMENTS

| | | | |
|---|---|---|---|
| 1,613,676 | 1/1927 | Raphael | 33/770 X |
| 3,231,278 | 1/1966 | Boalanger | 273/118 R |
| 3,504,914 | 4/1970 | Bradbury | 273/118 R |
| 3,741,543 | 6/1973 | McPhail et al. | 273/118 R |
| 3,834,030 | 9/1974 | Manson | 33/770 X |
| 4,986,542 | 1/1991 | Bonnet | 273/118 R |
| 5,125,669 | 6/1992 | Kanda | 273/118 R X |

FOREIGN PATENT DOCUMENTS

| | | | |
|---|---|---|---|
| 2127300 | 4/1984 | United Kingdom | 273/118 R |

OTHER PUBLICATIONS

"New Game to take along when camping", Camperways Magazine—1987 pp. 40–41.

*Primary Examiner*—Raleigh W. Chiu
*Attorney, Agent, or Firm*—Sheldon H. Parker

[57] ABSTRACT

The instant invention discloses a ball rolling game of moderate skill enjoyed equally by children and adults. At each end of a short court a stake is located, and a circle is inscribed around it as a scoring zone. Players roll balls at the stake, and points are scored based on ball(s) closest to the stake within the scoring zone. Two, three, four, six, or eight players may participate in the game based on individual or team play. The court surface may be wet packed sand, clay, dirt, grass, or artificial.

7 Claims, 2 Drawing Sheets

BALL ROLLING GAME

BACKGROUND OF THE INVENTION

1. Field of the Invention

The instant invention discloses a game, utilizing balls, which can be played on sand, grass or clay, as well as on professionally prepared surfaces.

2. Background of the Prior Art

Through out the centuries cultures have created games to be played on courts using balls. Many of these games roll the balls toward an object with the intent to hit or knock it over.

Bocce was first played in Italy in about 50 B.C. Bocce requires teams of two or four players, a 1½ inch ball called a "jack", 4½ inch diameter balls, and a flat dirt court 60'×10'. A board is placed on each side of the court to retain the balls within the playing area. Each player rolls four balls at the "jack", with the goal being to place each ball as close as possible to the "jack". At the end of a round, a player receives a point for every ball nearer the "jack" than the nearest opposing ball. This is repeated until one team receives twelve points for the game.

Lawn Bowling, or Bocce Ball, originated in ancient Egypt and later became popular in Rome and Greece. Lawn bowling uses a 4 ½ inch–5½ inch diameter ball with a bulge on one side rather than the usual round ball. The balls are less than 3½ pounds and are rolled down a 20' wide×120' long green with a shallow ditch on each side. Game score is 21 points.

Bowling first started in Egypt about 5000 B.C. and around 1100 A.D. the game moved to England. Indoor bowling, as played today, requires a substantial investment in equipment, special shoes, and employs strict rules. The balls used in bowling are also heavy and cumbersome and difficult for children to use.

All of the foregoing games require large, permanent courts, or lanes, which require a devoted area for play. Additionally, the length of the courts or lanes, makes it difficult for younger children to play the game with any success. Bowling has the additional problem that the balls are excessively heavy for children.

The instant invention discloses a game of moderate skill that can be enjoyed by children and adults. It is a safe game since no heavy objects are thrown and no sharp edges are present. The instant invention is fun to play for all ages because it does not require a lot of physical strength or dexterity as in bowling, lawn bowling, or bocce. No specially prepared or expensive surface area is required as in bowling, lawn bowling, or bocce and can be played on clay, dirt, grass, wet sand, or artificial surface. The court area required for the instant game is half that required for lawn bowling and bocce. The simplicity of setup time, court requirements, and a minimum of rules makes the instant game superior to other games where balls are rolled.

The instant game is one that small children can enjoy since their small hands can easily handle the size and weight of the balls used. The few rules of the game are not complicated and are easily understood. Point scoring in the instant game is simple and the length of time to play each game is short, not dragged out.

The heavy, large-diameter, out-of-round balls as used in lawn bowling and bocce are replaced by small, round, light-weight balls. The court playing area for the instant game is short and does not require side-boards, back-stops, gutters, or foul lines. Additionally, no heavy steel stakes, metal wickets, cues, mallets, or any cutting or sharp, pointed objects, providing a safe game for children.

SUMMARY OF THE INVENTION

A ball rolling game played on a court with a playing surface. The playing surface has a pair of circular areas spaced a predetermined distance from one another and a pair of parallel roll lines bisecting and extending beyond the circular areas. A pair of stakes are placed in the center of each of the circular areas. The stakes generally have a tapered end for insertion into the playing surface and a flat end, however a weighted base can replace the tapered end. A plurality of pairs of balls, the pairs having contrasting colors from the other pairs. A pair of measuring devices are used to mark the circumference of said circular area and measure the distance between the stake and the balls. The measuring device in one embodiment has collar portion with a circular cutout at one end and a string receiving area with a length of string equal to the radius of the circular area. A marking device having a point at one end is attached to the other end of the string. The marking device is generally designed to scribe the circle in the playing surface, however a holder for either a powdered substance or chalk can be provided. An alternative measuring device with a retractable, locking measuring tape is rotatably affixed to the second end of each stake. The measuring device is rotatable 360°. The measuring device further comprises a marked measuring tape with an optional handle/pointer at the end of the tape.

The game is played on grass, wet sand, artificial material or other non-slick surfaces.

A permanently marked playing court can be provided with ball retaining areas along the periphery. The ball retaining areas are preferably troughs, a portion of the troughs having a force absorbing material, such as sponge rubber.

BRIEF DESCRIPTION OF THE DRAWINGS

The advantages of the instant disclosure will become more apparent when read with the specification and the drawings, wherein.

DESCRIPTION OF THE PREFERRED EMBODIMENT

The ball rolling game is optimumly played on a gentle sloping beach on sand wetted and smoothed by the ocean tides, but can be played on various other surfaces both indoors and outdoors. The game can be played by two, three, four, six, or eight players and the court size can be varied to allow for the size and/or strength of the players. The versatility of the surfaces and the ease of setting up a court provide the instant game the distinct advantage of mobility over the prior art games.

TEMPORARY COURT

Figure 1:
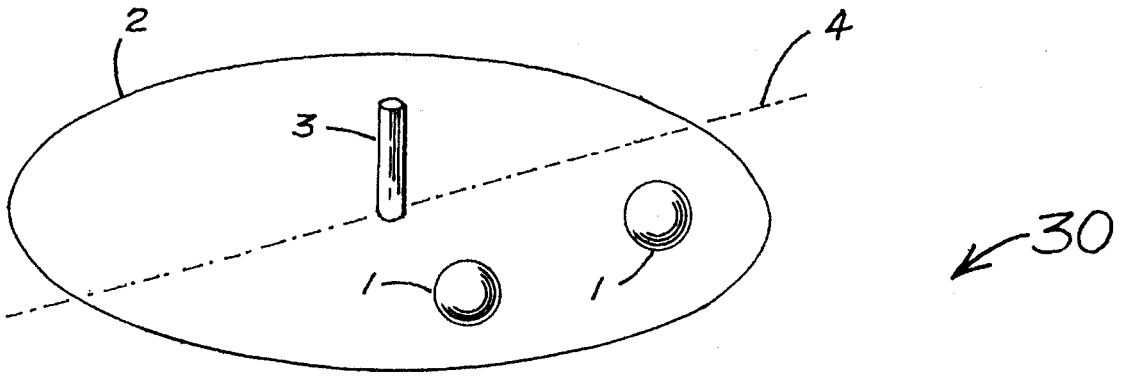
FIG. 1 is a perspective view showing the inscribed circle about each stake. The area within the circle defines the eligible scoring zone. These zones are at opposite ends of the court. Bisecting each circle is a scribed line denoting the roll line. Also shown are two balls within a scoring zone.
Figure 1:
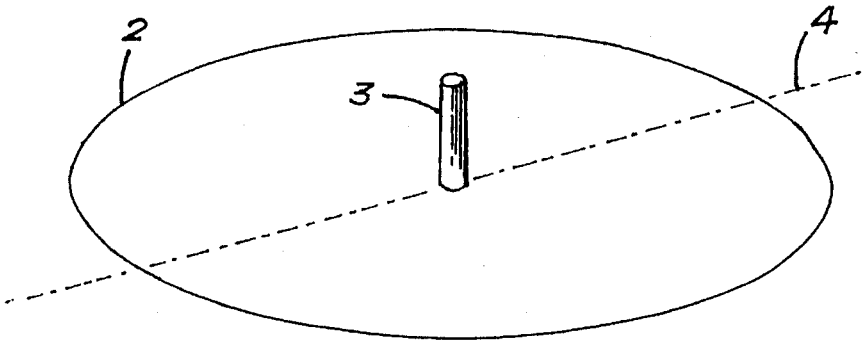

FIG. 1 illustrates the playing area 30 showing the playing circles 2. A stake 3 is placed in the center of each of the playing circles 2 and balls 1 are rolled toward the stake 3 with the intent of having the ball 1 stop as close to the stake 3 as possible.

Equipment Requirements

Figure 2:
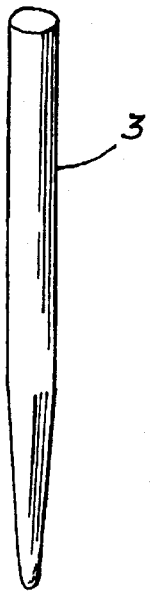
FIG. 2 is a perspective view of a stake of FIG. 1, showing the portion that is tapered and the rounded end.

The pair of required stakes 3 are illustrated in FIG. 2. Each stake 3 is approximately fifteen inches long and one inch in diameter. One end of each stake 3 is tapered, beginning approximately five inches from the end to a gradual, rounded point. The stake 3 can be made of a tough, elastic wood, i.e. ash or hickory, and then painted or coated with a high visibility coating. Alternatively, a hard, semi-flexible plastic, metal or composite may also be used with a high visibility outer surface.

Figure 3:
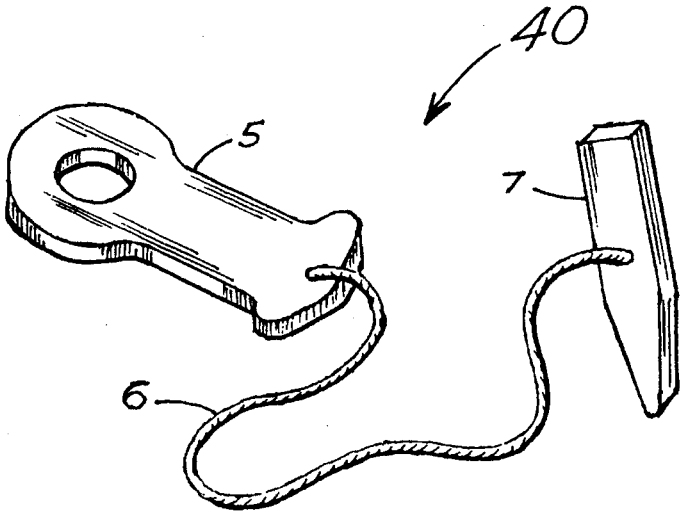
FIG. 3 is a perspective view of the measure/scribe. Twine is attached to the collar appendage and the opposite end of twine is attached to the scribe pin.
Figure 4:
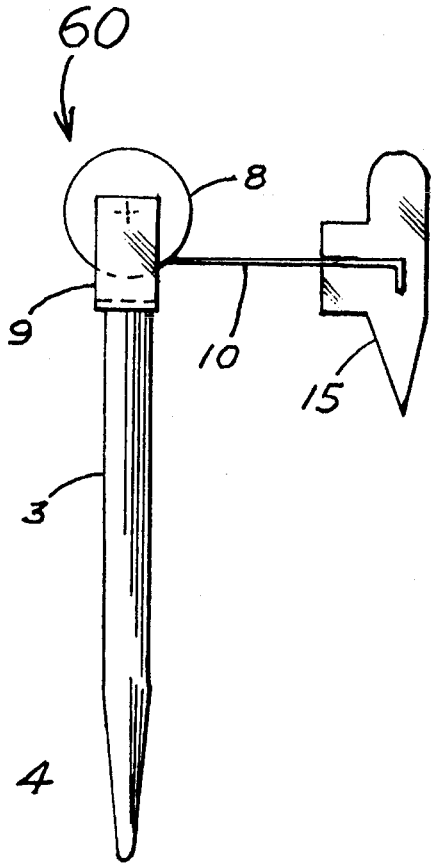
FIG. 4 is a side view of an alternate stake combining a bracketed measuring device.

FIG. 3 illustrates one of the pair of measure/scribe devices 40 which are utilized at each end of the court. The measure/scribe unit 40 is comprised of a plastic or metal collar 5 with a hole slightly larger than the stake 3 diameter. An appendage of the collar 5 provides space for twine 6 attachment and wind-up. From the end of the collar 5 appendage a length of nylon twine is attached. A diameter of approximately 0.1 inch and a length of approximately three feet provides the desired characteristics, however other dimensions can be used. The other end of the twine 6 is attached to a scribing pin 7, with a tapered end. The scribing pin 7 is approximately three inch long×½ inch wide×¼ inch thick and can be metal, plastic or other suitable material. The pin 7 is used to scribe the circle 2 about each stake 3. The pin 7 can also include a holder for either chalk or a powdered material for use on grass or other surfaces which cannot be etched with the pin 7. The area inside the six foot diameter circle 2 defines the scoring zone.

Multiple pairs of round balls 1 are required, with each pair being a distinct and different coloration, such as red, blue, green, and yellow. Generally four pairs of balls are used, however this number can be easily varied. Each ball 1 is solid and approximately four inches in diameter with a uniform weight of preferably twenty ounces. Balls 1 can be made of chip-proof, unbreakable plastic, hard rubber, or of a composition that is also split-proof and water-proof. The coloration and material of fabrication of the balls 1 should not be unduly affected by surface wear of the court, moisture, or sunlight.

A moisture resistant case for all of the equipment is desirable. The case must be dimensioned to hold the stakes, measuring device and balls. The case is preferably manufactured from plastic to provide a greater resistance to weather if left outdoors. Alternatively, wood treated for outdoor use can be used.

SCORING

The eligible scoring zone is defined as all the area within the approximately six foot diameter circle 2. If a ball 1 rests on the scribed circle 2, it does not score. At the end of a round, a player receives one point for every ball 1 nearer the stake 3 than the nearest opposing ball 1. Two points are scored for a ball 1 within one ball's diameter of the stake 3.

Only one player scores points in any round. The measure/scribe 40 is used to determine which ball 1 is closest to the stake 3 if contested. The collar 5 is placed over the stake 3 and the twine 6 is used to measure the distance of each of the balls 1 within the scoring circle 2. If opposing balls 1 are equal distance from the stake 3, they cancel out and neither ball 1 scores a point.

COURT REQUIREMENTS AND LAY-OUT

As stated previously, ball rolling game can be played on any relatively smooth, flat area comprised of wet sand, clay, dirt, grass, or an artificial surface.

The court is laid by inserting the two stakes 3 approximately thirty feet apart. This distance is not critical and can be shortened or lengthened as desired by the players. Once the stakes 3 are in place, a six foot diameter circle 2 is scribed about each stake 3 to define the scoring zone. This is done by using the measure/scribe unit 40. Place the collar 5 of the measure/scribe 40 over the stake 3, stretch the twine 6 to its outer-most length, and lightly scribe the circle 2 using the tapered end of the pin 7. Next, scribe a very shallow line 4 bisecting the six foot diameter circle 2 extending outward from each side of the stake 3 for a distance of five or six feet. This is the roll line 4.

PURPOSE OF THE GAME

The purpose of the instant game is to get the ball 1 within the scoring zone and as close to the stake 3 as possible. There is no penalty if a rolled ball 1 moves or knocks other balls 1 during play, since that may be the strategy of a player.

The player or team of players getting eleven points first wins the game.

All of the specifics mentioned in the description of the game shall not be construed as limitations of the scope of this invention, but rather as an exemplification of one preferred embodiment thereof.

Other variations are possible; for example, professionally laid-out and maintained courts, stricter rules of play, and more exacting specifications of equipment.

NUMBER OF PLAYERS

The ball rolling game can be played with two, three, four, six, or eight players. Individual scoring is used when two or three players participate. Team scoring is used when six or eight players participate. Individual scoring or team scoring may be used when four players participate.

HOW TO PLAY THE GAME

Each player or team chooses two balls 1 of the same color. Mutual consent determines which player begins play. Players stand behind the roll line 4 and alternatively roll the balls 1 toward the stake 3 at the opposite end of the court. When two or three players are participating, all players roll balls 1 toward one end of the court. When all have rolled, players walk to that end of the court and determine scoring. Play resumes toward the opposite stake 3. The player who scores a point or points rolls first for the succeeding round.

PERMANENT COURT

Court Surface

Figure 7:
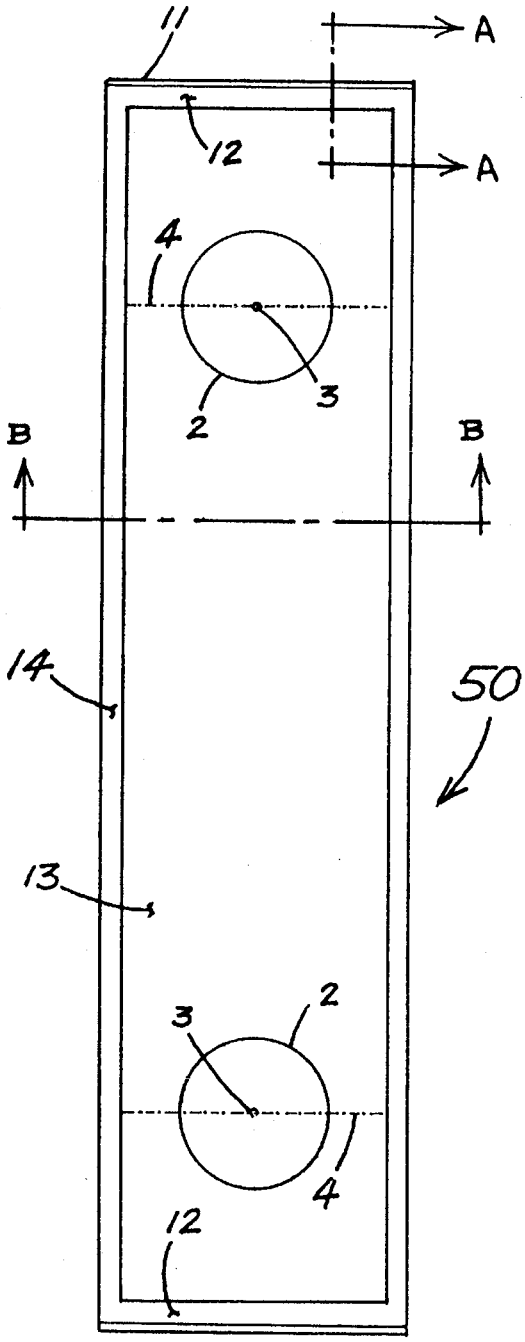
FIG. 7 is a plan view of an established permanent court.

The permanent court, illustrated in FIG. 7, is constructed similar to miniature golf courses. There is a hard resilient underlying surface covered with a resilient material 13. The fiber flexibility, pile density, tufts length, fiber compaction and composition are some of the factors involved in the consideration of the court surface material 13. The combination of the material 13 with the under-layer should provide a frictional resistance to a rolled ball equal to that of close-cropped grass or wet hardpacked sand. The material 13 must also be resistant to the traffic wear of the players. It is preferable that the court surface 13 be both flat and level throughout it's entire length and width.

Court Dimensions

The full-sized playing court 50 should be approximately 10 feet wide by 45 feet long. The distance between the stakes 3 should be approximately 30 feet. The court distance can be shortened, if so desired.

Figure 6:
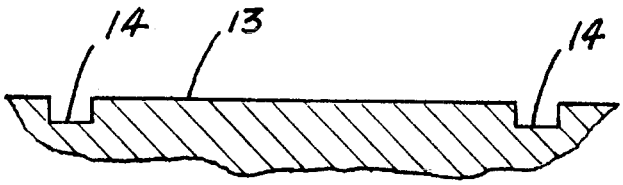
FIG. 6 is a cross-sectional view of the court showing the troughs at each side of the court.

The court 50 is bounded on the sides by side troughs 14 which must have a depth and width sufficient to prevent the majority of the balls from rolling beyond the outer perimeter created by the trough 14. The side trough 14, as shown in cross-section in FIG. 6, is approximately 8 inches wide by 4 inches deep, which provides a width and depth to prevent the balls from "rolling over" the trough 14. The trough 14 is preferably covered with the same material 13 as the court to slow the ball 1 and reduce ricocheting.

Figure 5:
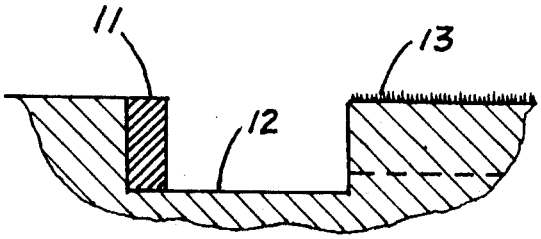
FIG. 5 is a cross-sectional view of the trough and cushioned pad, at the end of the playing court.

The end troughs 12, shown in FIG. 5, are provided at both ends of the court 50. The end trough 12 is wider and deeper than the side troughs 14 and extends the width of the court as well as the ends of the side troughs 14. The preferred width of the end trough 12 is 12 inches and the depth 5 inches. To further absorb the inertia of a fast rolling ball 1, a cushioned pad 11 is provided. The cushioned pad 11 can be manufactured from any force absorbing material, such as soft rubber, and is generally 2 inches thick and 5 inches high. The cushioned pad 11 is mounted on the vertical rise portion of the back side of the trough 11. The bottom of the trough 12 is preferably covered with the same material 13 as the court.

When a series of courts are installed walkways should be provided to reduce the traffic on the surface material 13.

Court Lay-out

As previously stated, the stakes 3 are positioned thirty feet apart with the eligible scoring zone defined as all the area inside the six foot diameter circle 2. When an artificial surface material 13 is used, contrasting colors can be used as an alternative to marking the diameter of the circle 2.

The circle 2 is bisected by the roll line 4 which extends five foot from each side of the stake 3 for the full 10 foot width of the court.

Point Scoring

On the permanent court 50, the stake 3 height above the court surface should be approximately 6 inches. A measuring device can be added to the top of each stake 3 to provide more accurate measuring of the balls 1. The measuring device comprises a flexible, retractable measuring tape housing 8 which has a measuring tape 10 capable of measuring at least four foot. The four foot minimum allows for the increase in distance due to the angle from the top of the stake 3 to the ball 1 as well as preventing the tape 10 from being pulled to its limit each time it is used. The measuring tape housing 8 is affixed to the stake 3 by tape bracket 9. The tape bracket 9 must allow the tape housing 8 to swivel 360 degrees in order to access all areas of the circle 2. A handle/pointer 15 can be fastened on the end of the measuring tape 10 to make the removal of the tape 10 from the tape housing 8 easier. It is preferable that the handle/pointer 15 be lightweight and easily affixed to and removed from the end of the tape 10. The handle/pointer 15 as illustrated herein has a pointed end which can be used for scribing the circles, however this is for illustration purposes and any handle shape can be incorporated. The tape 10 provides the means of determining the proximity of opposing balls 1 to the stake 3 for the purpose of point scoring. Point scoring is the same regardless of court surface or lay-out.

For maintaining an accurate tally of points scored, a mechanical or electronic tabulator and display board may be provided. This can be a simple electronic recording device positioned adjacent the court 50. Alternatively the balls 1 and the stake 3 can be provided with proximity sensors using different frequencies for each color. The sensor can register the distance between the stake 3 and the ball 1 and transmit this information to a LED type read-out device. Another alternative scoring device is a sensor mounted overhead. The overhead sensor can be used to read the distance between the ball 1 and the stake 3 and display the distance accordingly. Any of the sensing devices can be combined with a small computer device which tallys and displays the current score and indicates end of game. The sensor devices are advantageous in commercial setups when the user is charged by the game. This allows the central area to register how many games were played, number of players and subsequent charges. There are many sensing devices known in the prior art and many can be incorporated for use with in the instant invention.

Since other modifications and changes vary to fit particular operating requirements and environments will be apparent to those skilled in the art, the invention is not considered limited to the example chosen for the purposes of disclosure, and covers all changes and modifications which do not constitute departures from the true spirit and scope of this invention.

What is claimed is:

1. The method of playing a ball rolling game for at least two players having:

a court area, said court area having a playing surface, a pair of circular areas, said circular areas being spaced a predetermined distance from one another within said playing surface, a pair of roll lines, each of said pair of roll lines bisecting and extending beyond said circular areas, said roll lines being approximately parallel to one another, a pair of stakes, said stakes having a first end and a second end, said stakes being placed in the center of said circular area, a plurality of pairs of balls, each said pairs having the same color and each of said pairs of balls having contrasting colors to said other pairs of balls, a pair of measuring means, having:

a collar portion, said collar portion having a first end and a second end, said first end containing a circular hole portion, said circular hole portion having a diameter slightly greater than the diameter of said pair of stakes, and said second end containing a string receiving portion, a length of string, said length of string having a first end, a second end, said length being equal to the radius of said circular area, a marking means, said marking means having a point and a string receiving area, said first end of said string being affixed to said string receiving portion of said collar portion and said second end of said string being attached to said string receiving area of said marking means, setting up the court area comprising the steps of:

i) determining the court area, ii) placing a first stake approximate the first end of said court area, iii) placing said collar of said measuring means over said stake, iv) extending said string to its maximum length and scribing a circle around said stake using said marking means, v) placing a second stake approximate the second end of the court area, vi) repeating steps iii and iv, playing the ball rolling game comprising the steps of:

a) choosing a pair of identical colored balls, b) said players standing behind said roll line of the first circular area, c) the first of said players rolling the first of said pair of balls toward said stake in the second circular area, attempting to cause said ball to stop close to said stake, d) repeating step c by each player, e) the first of said players rolling the second of said pair of balls toward said stake in the second circular area, attempting to cause said ball to stop close to said stake, f) repeating step e by each player, g) said players proceeding to said second circular area, h) measuring the distance between the closest balls and the stake using said measuring means, i) determining if any player's ball is within one ball width from said stake, j) if a player has a ball within one ball width of said stake, awarding said player two points, k) if no player has a ball within one ball's width of said stake, determining which player's ball is closest, l) awarding the player whose ball is the closest to the stake with one point, m) said players standing behind said roll line of the second circular area, n) the first of said players rolling the first of said pair of balls toward said stake in the first circular area, attempting to cause said ball to stop close to said stake, o) repeating step p by each player, p) the first of said players rolling the second of said pair of balls toward said stake in the first circular area, attempting to cause said ball to stop close to said stake, q) repeating step p by each player, r) said players proceeding to said first circular area, s) measuring the distance between the closest balls and the stake using said measuring means, t) determining which, if any, player's ball is within one ball width from said stake, u) if a player has a ball within one ball width of said stake, awarding said player two points, v) if no player has a ball within one ball's width of said stake, determining which player's ball is closest, w) awarding the player whose ball is the closest to the stake with at least one point, x) repeating steps b–w until one player has a predetermined number of points.

2. The method of playing a ball rolling game for at least two players having:

a court area, said court area having a playing surface, a pair of circular areas, said circular areas being spaced a predetermined distance from one another within said playing surface, a pair of roll lines, each of said pair of roll lines bisecting said circular areas, said roll lines being approximately parallel to one another, a pair of stakes, said stakes having a first end and a second end, said stakes being placed in the center of said circular area, a plurality of pairs of balls, each ball of said plurality of pairs of balls having the same color and each of said pairs of balls having colors different from said other pairs of balls, a pair of measuring means, having:

a collar portion, said collar portion having a first end and a second end, said first end containing a circular hole portion, said circular hole portion having a diameter slightly greater than the diameter of said pair of stakes, and said second end containing a string receiving portion, a length of string, said length of string having a first end, a second end, said length being equal to the radius of said circular area, a marking means, said marking means having a point and a string receiving area, said first end of said string being affixed to said string receiving portion of said collar portion and said second end of said string being attached to said string receiving area of said marking means, setting up the court area comprising the steps of:

i) determining the court area, ii) placing a first stake approximate the first end of said court area, iii) placing said collar of said measuring means over said stake, iv) extending said string to its maximum length and scribing a circle around said stake using said marking means, v) placing a second stake approximate the second end of the court area, vi) repeating steps iii and iv, playing the ball rolling game comprising the steps of:

a) choosing a pair of identical colored balls, b) said players standing behind said roll line of the first circular area, c) the first of said players rolling the first of said pair of balls toward said stake in the second circular area, attempting to cause said ball to stop close to said stake, d) repeating step c by each player, e) the first of said players rolling the second of said pair of balls toward said stake in the second circular area, attempting to cause said ball to stop close to said stake, f) repeating step e by each player, g) said players proceeding to said second circular area, h) measuring the distance between the closest balls and the stake using said measuring means, i) determining if any player's ball is within one ball width from said stake, j) if a player has a ball within one ball width of said stake, awarding said player a first predetermined number of points, k) if no player has a ball within one ball's width of said stake, determining which player's ball is closest, l) awarding the player whose ball is the closest to the stake with a second predetermined number of points, m) said players standing behind said roll line of the second circular area, n) the first of said players rolling the first of said pair of balls toward said stake in the first circular area, attempting to cause said ball to stop close to said stake, o) repeating step p by each player, p) the first of said players rolling the second of said pair of balls toward said stake in the first circular area, attempting to cause said ball to stop close to said stake, q) repeating step p by each player, r) said players proceeding to said first circular area, s) measuring the distance between the closest balls and the stake using said measuring means, t) determining which, if any, player's ball is within one ball width from said stake, u) if a player has a ball within one ball width of said stake, awarding said player said first predetermined number of points, v) if no player has a ball within one ball's width of said stake, determining which player's ball is closest, w) awarding the player whose ball is the closest to the stake said second predetermined number of points, x) repeating steps b–w until one player has a third predetermined number of points.

3. The method of playing the ball rolling game of claim 2 wherein said court area is a permanently marked surface having ball retaining means along the periphery of said court.

4. The method of playing the ball rolling game of claim 3 wherein said ball retaining means are troughs, said troughs having a width sufficient to cause a moving ball to drop into said trough and a depth sufficient to retain said ball.

5. The method of playing the ball rolling game of claim 4 wherein said troughs further comprise force absorbing means along at least a portion of said troughs.

6. The method of playing the ball rolling game of claim 2 wherein said first end of each of said pair of stakes has a tapered end and the second end of each of said pair of stakes has a flat end.

7. The method of playing the ball rolling game of claim 2 wherein said first end of each of said pair of stakes has a weighted base.

* * * * *